United States Patent [19]

Frank

[11] Patent Number: 4,844,864

[45] Date of Patent: Jul. 4, 1989

[54] PRECIPITATION HARDENABLE, NICKEL-BASE ALLOY

[75] Inventor: Richard B. Frank, Muhlenberg, Pa.

[73] Assignee: Carpenter Technology Corporation, Reading, Pa.

[21] Appl. No.: 186,792

[22] Filed: Apr. 27, 1988

[51] Int. Cl.[4] ..... C22C 19/05

[52] U.S. Cl. ..... 420/447; 420/443; 420/448

[58] Field of Search ..... 420/447, 448, 443; 148/410

[56] References Cited

U.S. PATENT DOCUMENTS 2,570,193 10/1951 Bieber et al. ..... 148/410
3,575,734 4/1971 Muzyka et al. ..... 148/2

OTHER PUBLICATIONS

Military Specification MIL-N-24114D(SH), *Nickel--Chromium-Iron Age-Hardenable Alloy Bars, Rods, and Forgings,* Department of the Navy (8/87).

C. A. Grove, L. D. Petzold, *Mechanism of Stress Corrosion Cracking of Alloy X-750 in High Purity Water,* Proc. of the Int'l. Conf. on Corrosion of Nickel-Base Alloys, ASM, Metals Park, Ohio (1985).

*Primary Examiner*—R. Dean

*Attorney, Agent, or Firm*—Dann, Dorfman, Herrell and Skillman

[57] ABSTRACT

A precipitation hardenable, nickel-base alloy having improved intergranular stress corrosion cracking resistance in water environments at temperatures up to about 700° F. is disclosed containing in weight percent about:

| | w/o |
|---|---|
| Carbon | up to 0.25 |
| Manganese | up to 1.0 |
| Silicon | up to 0.80 |
| Phosphorus | up to 0.025 |
| Sulfur | up to 0.010 |
| Chromium | 10-25 |
| Molybdenum | up to 1 |
| Aluminum | 0.2-1.5 |
| Titanium | 1.5-3 |
| Niobium | 0.10-3 |
| Iron | 0.1-20 |
| Boron | 0.0005-0.004 |
| Copper | up to 2.0 |
| Cobalt | up to 25 |
| Zirconium | up to 0.07 |

the balance being essentially nickel. The unique properties of the alloy are provided within the stated ranges when: (a) at least about 0.30% molybdenum is present when the allow contains more than about 0.003% boron and more than about 0.001% zirconium; (b) no more than about 0.002% boron is present when the alloy contains more than about 0.05% zirconium; and (c) not more than about 0.001% zirconium is present when the alloy contains at least about 0.003% boron and less than about 0.01% molybdenum.

18 Claims, No Drawings

PRECIPITATION HARDENABLE, NICKEL-BASE ALLOY

BACKGROUND OF THE INVENTION

This invention relates to precipitation hardenable, nickel base alloys and more particularly to such an alloy having improved resistance to stress corrosion cracking.

An alloy has heretofore been made and sold under the designation X-750 alloy for use where a good combination of a strength and corrosion resistance is required. X-750 alloy has been produced and sold by The assignee of the present application, Carpenter Technology Corporation, having the following composition in weight percent:

| | w/o |
|---|---|
| Carbon | 0.08 max. |
| Manganese | 0.50 max. |
| Silicon | 0.50 max. |
| Phosphorus | 0.015 max. |
| Sulfur | 0.010 max. |
| Chromium | 14.0–17.0 |
| Molybdenum | 0.26 max. |
| Cobalt | 1.0 max. |
| Titanium | 2.25–2.70 |
| Aluminum | 0.40–1.00 |
| Columbium | 0.70–1.20 |
| Copper | 0.5 max. |
| Boron | 0.003–0.008 |
| Zirconium | 0.015–0.070 |
| Iron | 5.0–9.0 |
| Nickel | Balance |

Nickel constitutes about 70% by weight of the alloy. Included in the "Balance" are the usual incidental impurities. Here and throughout this application percent (%) means percent by weight unless otherwise indicated.

X-750 alloy has been used in the nuclear power industry for making nuclear reactor parts for service in pure water at temperatures up to about 700° F. It has been found however that the resistance to intergranular stress corrosion cracking (hereinafter: stress corrosion cracking) of the X-750 alloy in such environments leaves something to be desired. Accordingly, it is a principal object of the present invention to provide an alloy having improved resistance to stress corrosion cracking and which is comparable in strength to the X-750 alloy.

SUMMARY OF THE INVENTION

In accordance with this invention, an age hardenable, nickel-base alloy is provided having mechanical properties comparable to X-750 alloy but with improved resistance to stress corrosion cracking in water environments at temperatures up to about 700° F. The alloy of this invention consists essentially of, in weight percent, about:

| | Broad | Intermediate | Preferred |
|---|---|---|---|
| C | up to .25 | up to .10 | up to .06 |
| Mn | up to 1.0 | up to .50 | up to .50 |
| Si | up to .80 | up to .50 | up to .50 |
| P | up to 0.025 | up to .015 | up to .010 |
| S | up to .010 | up to .005 | up to .002 |
| Cr | 10–25 | 12–18 | 14.0–17.0 |
| Mo | up to 1 | up to .6 | up to .5 |
| Al | .2–1.5 | .40–1.00 | .40–1.00 |
| Ti | 1.5–3 | 2.25–2.75 | 2.25–2.75 |

-continued

| | Broad | Intermediate | Preferred |
|---|---|---|---|
| Nb | .10–3 | .25–1.5 | .70–1.20 |
| Fe | .1–20 | 4–15 | 5.0–9.0 |
| B | .0005–.004 | .0005–.003 | .0010–.002 |
| Cu | up to 2.0 | up to .50 | up to .50 |
| Co | up to 25 | up to 1.0 | up to .10 |
| Zr | up to .07 | up to .05 | up to .001 |
| Ni | Bal. | Bal. | Bal. |

Included with the balance (Bal.) are incidental impurities which do not detract from the desired properties. For example, up to about 0.03% max., preferably 0.01% max. of one or more of the elements magnesium, calcium, cerium and lanthanum can be present as residuals from deoxidizing and/or desulfurizing additions. Furthermore, each of the following elements is limited to no more than about 0.005% max. and preferably to less than about 0.002% max.: arsenic, antimony, tin, bismuth, lead, selenium and tellurium. The total of all such elements is limited to not more than about 0.010% max. and preferably to less than about 0.005%.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges.

Here and throughout this application it is intended by reference to niobium to include the usual amount of tantalum found in commercially available niobium alloys used in making alloying additions of niobium to commercial alloys.

In the nickel-base alloy of this invention the elements are critically balanced to provide both the good mechanical properties of the X-750 alloy and improved resistance to stress corrosion cracking in water. In this regard, boron, zirconium and molybdenum are closely controlled within the above-indicated ranges such that (a) at least about 0.30% molybdenum is present when the alloy contains more than about 0.003% boron and more than about 0.001% zirconium, (b) no more than about 0.002% boron is present when the alloy contains more than about 0.05% zirconium, and (c) not more than about 0.001% zirconium is present when the alloy contains at least about 0.003% boron and less than about 0.01% molybdenum.

DETAILED DESCRIPTION OF THE INVENTION

The alloy of the present invention has a fully austenitic microstructure in which the elements iron, nickel, chromium, aluminum, titanium, niobium and boron coact to provide the unique properties of the alloy. In this regard, about 0.1 to 20 w/o, better yet about 4–15%, and preferably about 5.0 to 9.0% iron is present in the alloy. Nickel contributes to the oxidation and corrosion resistance of this alloy and also reacts with other elements, as explained more fully hereinbelow, to form strengthening phases during heat treatment of the alloy. Accordingly, at least about 50%, preferably at least about 60% nickel is present. For best results at least about 70% nickel is present. Broadly stated, up to about 25% max. cobalt can be present in the alloy as a substitute for some of the nickel. However, cobalt is preferably limited to not more than about 1.0% max. and better yet to less than about 0.10% when the alloy is intended for use in nuclear reactor applications because in such environments cobalt can form radioactive isotopes which give off hazardous nuclear radiation.

Aluminum, titanium and niobium are strengthening elements which react with some of the nickel to form one or more strengthening phases. Such phases are brought out as intragranular precipitates by an age hardening heat treatment. The compositions of those phases are generalized as $Ni_3$ (Nb, Ti, Al) and may include gamma prime and/or gamma double-prime, the structures of which are known to those skilled in the art. To this end, about 0.2 to 1.5%, preferably about 0.40 to 1.00% aluminum; about 1.5 to 3%, preferably about 2.25 to 2.75% titanium; and about 0.10 to 3%, preferably about 0.25 to 1.5% niobium are present in the alloy. For best results, niobium is limited to about 0.70 to 1.20%.

Chromium contributes to the oxidation and corrosion resistance and the solid solution strength of this alloy. Accordingly, at least about 10%, preferably at least about 12% chromium is present in the alloy. Because too much chromium adversely affects the stress rupture properties and the hot workability of the alloy, it is limited to no more than about 25%, preferably to not more than about 18%. For best results about 14.0–17.0% chromium is present.

Boron is a required element in this composition to ensure the good resistance to stress corrosion cracking in water at temperatures up to about 700° F., which is characteristic of the alloy of the present invention. To that end at least about 0.0005% boron is present in the alloy. The beneficial effect of boron on the stress corrosion cracking resistance of this alloy diminishes to an undesirable level when more than about 0.004% boron is present. Boron is thus preferably limited to no more than about 0.003%. For best results, about 0.0010 to 0.002% boron is present.

Up to about 1% max., preferably up to about 0.6% max., better yet up to about 0.5% max., e.g. 0.40%, molybdenum can be included in this alloy for its beneficial effect on the stress corrosion cracking resistance of the alloy. Molybdenum in excess of about 1% adversely affects the hot workability of the alloy. In order to obtain the best resistance to stress corrosion cracking in water at least about 0.30% molybdenum is present.

The following optional elements can also be present in this alloy. Up to about 2.0% max., preferably up to about 0.50% max. copper can be present because of its beneficial effect on low temperature corrosion resistance. Up to about 1.0% max., preferably up to about 0.50% max. manganese and up to 0.80% max., preferably up to about 0.50% max. silicon also can be present.

Zirconium is an undesirable element in the present alloy because of its adverse effect on the alloy's resistance to intergranular stress corrosion cracking in water, but it can be tolerated up to about 0.07% max. As will be explained more fully hereinbelow, zirconium is preferably limited to not more than about 0.05% max. and for best results, to less than about 0.001%.

Depending on the melting practice employed, carbon may be present in greater or lesser amounts. In that regard, up to about 0.25% max., preferably 0.10% max. carbon may be present. For best results, carbon is limited to about 0.06% max. Phosphorus and sulfur are not desirable in the alloy and accordingly phosphorus is limited to about 0.025% max., preferably to about 0.015% max., and better yet to about 0.010% max. Sulfur is limited to about 0.010% max., preferably to about 0.005% max. and better yet to about 0.002% max. Levels of other elements such as arsenic, antimony, tin, bismuth, lead, selenium and tellurium are preferably kept low. Accordingly, each of those elements is limited to not more than about 0.005% and preferably to not more than about 0.002%. For best results the sum of the weight percents of the aforesaid elements does not exceed about 0.010 and better yet is not more than about 0.005. One or more of the elements magnesium, calcium, cerium and lanthanum can be present up to about 0.03% max., preferably up to 0.01% max., as residuals when used as deoxidizing and/or desulfurizing additions.

Within the above-stated ranges boron, molybdenum and zirconium are critically balanced to provide the improvement in stress corrosion cracking resistance in water that is characteristic of the alloy of the present invention. In that regard (a) at least about 0.30% molybdenum is present when the alloy contains more than about 0.003% boron and more than about 0.001% zirconium, (b) no more than about 0.002% boron is present when the alloy contains more than about 0.05% zirconium, and (c) not more than about 0.001% zirconium is present when the alloy contains at least about 0.003% boron and less than about 0.01% molybdenum.

The alloy of the present invention is preferably melted using a double vacuum melting technique. For example, a heat is first melted under vacuum in an induction furnace (VIM). The heat is then cast as an electrode and remelted in a vacuum arc remelting (VAR) furnace into ingots or other desired forms. The alloy can be hot worked from a temperature of about 1800°–2200° F., preferably from about 2000°–2100° F. with reheating as necessary. The good tensile strength characteristic of the present alloy is developed by a two step heat treatment. The preferred heat treatment includes solution treating at about 1975°–2050° F. for a time which is dependent on the dimensions of the article, preferably 1–2 h. After solution treatment cooling is preferably accomplished at a rate equivalent to air cooling or faster. Age hardening is preferably carried out at about 1300°–1350° F. for about 16–24 hours following by cooling in air.

In the heat-treated condition, the alloy of the present invention has a room temperature yield strength (0.2% yield strength) comparable to the X-750 alloy and excellent resistance to stress corrosion cracking in water as indicated by a rising load test time of at least about 10 minutes. The preferred composition of the alloy provides a rising load test time of at least about 15 minutes. The rising load test is a standard test described in Military Specification MIL-N-24114D(SH), Appendix C (28 August 1987), which provides a measure of the stress corrosion cracking resistance of the X-750 alloy in water.

This alloy can be formed into a wide variety of shapes for a multitude of uses and it leads itself to the formation of billets, bars, rod and wire. The alloy is particularly suited for use in nuclear power reactor applications such as bolts, springs, guide tube pins and other structural members which are utilized in highly purified water environments at temperatures up to about 700° F.

EXAMPLES

Examples 1–7 of this invention and comparative heats A-E outside the claimed ranges, having the analyses shown in Table I, were vacuum induction melted and cast as $3\frac{1}{4}$ inch square ingots.

TABLE I

| Alloy | C | Mn | Si | P | S | Cr | Ni | Mo | Co | Ti | Al | Nb | B | Zr | Mg | Fe |
|---|---|---|---|---|---|---|---|---|---|---|---|---|---|---|---|---|
| 1 | 0.045 | 0.10 | 0.03 | 0.007 | 0.002 | 15.44 | 71.79 | <0.01 | 0.03 | 2.48 | 0.67 | 0.86 | 0.0008 | <0.001 | 0.003 | Bal |
| 2 | 0.046 | 0.10 | 0.03 | 0.005 | 0.002 | 15.48 | 71.75 | <0.01 | 0.04 | 2.46 | 0.67 | 0.85 | 0.0019 | <0.001 | 0.003 | Bal |
| 3 | 0.029 | 0.10 | 0.03 | 0.006 | 0.001 | 15.53 | 72.58 | <0.01 | 0.03 | 2.52 | 0.65 | 0.83 | 0.0020 | <0.001 | 0.010 | Bal |
| 4 | 0.029 | 0.10 | 0.04 | 0.005 | 0.002 | 15.58 | 72.32 | <0.01 | 0.03 | 2.49 | 0.67 | 0.82 | 0.0021 | 0.036 | 0.010 | 7.81 |
| 5 | 0.045 | 0.11 | 0.02 | 0.007 | 0.002 | 15.51 | 71.83 | <0.01 | 0.04 | 2.53 | 0.68 | 0.82 | 0.0021 | 0.043 | 0.005 | Bal |
| 6 | 0.043 | 0.11 | 0.02 | 0.008 | 0.002 | 15.54 | 72.04 | 0.41 | 0.04 | 2.49 | 0.68 | 0.86 | 0.0022 | <0.001 | 0.005 | Bal |
| 7 | 0.042 | 0.07 | 0.03 | 0.008 | 0.001 | 15.39 | 72.62 | 0.37 | 0.024 | 2.45 | 0.69 | 0.83 | 0.0034 | 0.045 | 0.011 | 7.96 |
| A | 0.028 | 0.10 | 0.03 | 0.006 | 0.002 | 15.39 | 72.17 | <0.01 | 0.03 | 2.53 | 0.68 | 0.83 | 0.0030 | 0.035 | 0.011 | Bal |
| B | 0.039 | 0.07 | 0.03 | 0.005 | 0.001 | 15.31 | 72.81 | <0.01 | — | 2.39 | 0.66 | 0.84 | 0.0036 | 0.045 | 0.012 | 8.03 |
| C | 0.030 | 0.10 | 0.04 | 0.006 | 0.002 | 15.49 | 72.27 | <0.01 | 0.03 | 2.51 | 0.68 | 0.83 | 0.0016 | 0.077 | 0.007 | Bal |
| D | 0.040 | 0.08 | 0.03 | 0.006 | 0.001 | 15.52 | 72.27 | <0.01 | 0.03 | 2.51 | 0.65 | 0.80 | 0.0002 | <0.001 | 0.013 | Bal |
| E | 0.032 | 0.09 | 0.03 | 0.005 | 0.001 | 15.59 | 72.31 | <0.01 | 0.03 | 2.50 | 0.68 | 0.83 | 0.0001 | 0.037 | 0.007 | 7.80 |

The ingots were homogenized at 2275° F. for 24 h in an inert atmosphere and press forged to 1 in $\times 1\frac{1}{4}$ in bars from 2100° F. using a reheat at $1\frac{1}{2}$ in square. The forged bars were hot rolled to $\frac{1}{2}$ in $\times 1\frac{3}{8}$ in bar from 2050° F. The hot rolled bars were heat treated by solution treating at 2025° F. for 1 h, quenching in air and then age-hardening at 1300° F. for 20 h followed by cooling in air. Standard test specimens were prepared from the heat treated bars and subjected to a rising load test as specified in Military Specification MIL-N-24114D(SH), Appendix C (28 August 1987). The rising load test provides a mesure of the resistance of the X-750 alloy to stress-corrosion cracking in water at temperatures up to 700° F.

Results of duplicate rising load tests for each composition are shown in Table II as the measured and average times in minutes (mins.) required for the load on the pre-cracked specimen to drop from the maximum value to $\frac{1}{2}$ the maximum value. A longer test time indicates better resistance to crack propagation.

TABLE II

| | Rising Load Test Time (mins.) | | |
|---|---|---|---|
| Alloy | Test 1 | Test 2 | Avg. |
| 1 | 38.8 | 39.6 | 39.2 |
| 2 | 13.4 | 34.8 | 24.1 |
| 3 | 25.8 | 26.7 | 26.2 |
| 4 | 20.5 | 19.7 | 20.1 |
| 5 | 21.9 | 20.6 | 21.3 |
| 6 | 27.5 | 34.3 | 30.9 |
| 7 | 11.6 | 14.1 | 12.9 |
| A | 2.4 | — | 2.4 |
| B | 6.1 | 7.4 | 6.7 |
| C | 8.1 | 9.1 | 8.6 |
| D | 4.6 | 4.3 | 4.4 |
| E | 1.2 | 1.5 | 1.4 |

The data of Table II demonstrates the superior stress corrosion cracking resistance of the present alloy as represented by the significantly higher rising load test times. Furthermore, when the data of Table II is considered in connection with the chemical analysis data of Table I, it is apparent that the alloy of the present invention is critically balanced to provide the highly desirable improvement in stress corrosion cracking resistance.

It can be seen from the foregoing description and the accompanying examples, that the alloy according to the present invention provides excellent resistance to stress corrosion cracking as indicated by the significant increase in the rising load test time. The alloy because of its outstanding stress corrosion cracking resistance and high strength, is especially advantageous for the fabrication of structural members and fasteners used in water environments at temperatures up to 700° F., such as found in nuclear power reactors.

The terms and expressions which have been employed are used as terms of description and not of limitation. There is no intention in the use of such terms and expressions of excluding any equivalents of the features described or portions thereof. It is recognized, however, that various modifications are possible within the scope of the invention claimed.

What is claimed:

1. An age hardenable, nickel-base alloy consisting essentially, in weight percent, of about

| | w/o |
|---|---|
| Carbon | up to 0.25 |
| Manganese | up to 1.0 |
| Silicon | up to 0.80 |
| Phosphorus | up to 0.025 |
| Sulfur | up to 0.010 |
| Chromium | 10–25 |
| Molybdenum | up to 1 |
| Aluminum | 0.2–1.5 |
| Titanium | 1.5–3 |
| Niobium | 0.10–3 |
| Iron | 0.1–20 |
| Boron | 0.0005–0.004 |
| Copper | up to 2.0 |
| Cobalt | up to 25 |
| Zirconium | up to 0.07 |

and the balance is essentially nickel, said alloy being balanced within the stated ranges such that (a) at least about 0.30% molybdenum is present when the alloy contains more than about 0.003% boron and more than about 0.001% zirconium; (b) no more than about 0.002% boron is present when the alloy contains more than about 0.05% zirconium; and (c) not more than about 0.001% zirconium is present when the alloy contains at least about 0.003% boron and less than about 0.01% molybdenum.

2. The alloy set forth in claim 1 containing up to about 0.003% boron.

3. The alloy set forth in claim 2 containing not more than about 0.05% max. zirconium.

4. The alloy set forth in claim 3 containing up to about 0.6% max. molybdenum.

5. The alloy set forth in claim 4 containing at least about 0.0010% boron.

6. The alloy set forth in claim 1 containing less than about 0.001% zirconium.

7. The alloy set forth in claim 1 containing up to about 0.005% max. sulfur and up to about 0.015% max. phosphorus.

8. An age hardenable, nickel-base alloy as set forth in claim 1 consisting essentially, in weight percent, of about

| | w/o |
|---|---|
| Carbon | up to 0.10 |
| Manganese | up to 0.50 |
| Silicon | up to 0.50 |
| Phosphorus | up to 0.015 |
| Sulfur | up to 0.005 |
| Chromium | 12–18 |
| Molybdenum | up to 0.6 |
| Aluminum | 0.40–1.00 |
| Titanium | 2.25–2.75 |
| Niobium | 0.25–1.5 |
| Iron | 4–15 |
| Boron | 0.0005–0.003 |
| Copper | up to 0.50 |
| Cobalt | up to 1.0 |
| Zirconium | up to 0.05 |

and the balance is essentially nickel.

9. The alloy set forth in claim 8 containing at least about 0.30% molybdenum.

10. The alloy set forth in claim 8 containing up to about 0.002% boron.

11. The alloy set forth in claim 10 containing at least about 0.0010% boron.

12. The alloy set forth in claim 11 containing up to about 0.5% max. molybdenum.

13. The alloy set forth in claim 8 containing no more than about 0.001% max. zirconium.

14. The alloy set forth in claim 8 containing up to about 0.002% max. sulfur and up to about 0.010% max. phosphorus.

15. The alloy set forth in claim 8 containing at least about 70% nickel.

16. An age hardenable, nickel-base alloy consisting essentially, in weight percent, of about:

| | w/o |
|---|---|
| Carbon | up to 0.06 |
| Manganese | up to 0.50 |
| Silicon | up to 0.50 |
| Phosphorus | up to 0.010 |
| Sulfur | up to 0.002 |
| Chromium | 14.0–17.0 |
| Molybdenum | up to 0.5 |
| Aluminum | 0.40–1.00 |
| Titanium | 2.25–2.75 |
| Niobium | 0.70–1.20 |
| Iron | 5.0–9.0 |
| Boron | 0.0010–0.002 |
| Copper | up to 0.50 |
| Cobalt | up to 0.10 |
| Zirconium | up to 0.001 |

and the balance is essentially nickel.

17. The alloy set forth in claim 16 containing at least about 70% nickel.

18. The alloy set forth in claim 17 containing at least about 0.30% molybdenum.

* * * * *